US006783085B2

(12) United States Patent
Xu

(10) Patent No.: US 6,783,085 B2
(45) Date of Patent: Aug. 31, 2004

(54) FUEL INJECTOR SWIRL NOZZLE ASSEMBLY

(75) Inventor: Min Xu, Canton, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 235 days.

(21) Appl. No.: 10/061,989

(22) Filed: Jan. 31, 2002

(65) Prior Publication Data

US 2003/0141385 A1 Jul. 31, 2003

(51) Int. Cl.[7] ..... B05B 1/34; B05B 1/30

(52) U.S. Cl. ..... 239/463; 239/468; 239/494; 239/497; 239/533.14; 239/88

(58) Field of Search ..... 239/461, 463, 239/466, 468, 471, 472, 473, 483, 494, 496, 497, 533.2, 533.3, 533.14, 88, 91, 585.5

(56) References Cited

U.S. PATENT DOCUMENTS

| | | | | |
|---|---|---|---|---|
| 4,018,387 A | | 4/1977 | Erb et al. | |
| 4,389,986 A | | 6/1983 | Tanasawa | |
| 4,643,359 A | * | 2/1987 | Casey | 239/585.4 |
| 4,907,748 A | | 3/1990 | Gardner et al. | |
| 4,945,877 A | | 8/1990 | Ziegler et al. | |
| 5,058,548 A | | 10/1991 | Morikawa et al. | |
| 5,237,975 A | | 8/1993 | Betki et al. | |
| 5,335,635 A | | 8/1994 | Kadoi et al. | |
| 5,383,597 A | | 1/1995 | Sooriakumar et al. | |
| 5,398,655 A | | 3/1995 | Tuckey | |
| 5,449,114 A | | 9/1995 | Wells et al. | |
| 5,570,841 A | | 11/1996 | Pace et al. | |
| 5,673,670 A | | 10/1997 | Powell et al. | |
| 5,740,967 A | | 4/1998 | Simmons et al. | |
| 5,762,272 A | | 6/1998 | Tani et al. | |
| 5,911,366 A | | 6/1999 | Maier et al. | |
| 5,941,207 A | | 8/1999 | Anderson et al. | |
| 6,065,692 A | | 5/2000 | Brinn, Jr. | |
| 6,142,390 A | * | 11/2000 | Nordstrom et al. | 239/490 |
| 6,179,227 B1 | * | 1/2001 | Ren et al. | 239/497 |
| 6,227,164 B1 | | 5/2001 | Miller | |

FOREIGN PATENT DOCUMENTS

| | | |
|---|---|---|
| EP | 1 186 774 A2 | 3/2002 |
| WO | WO 95/04881 | 2/1995 |

OTHER PUBLICATIONS

English Abstract of Japanese Patent JP7035001, (Feb. 2, 1995).

* cited by examiner

*Primary Examiner*—Davis Hwu
(74) *Attorney, Agent, or Firm*—Brinks Hofer Gilson & Lione

(57) ABSTRACT

A fuel injector nozzle assembly includes an injector body including a valve seat with a supply passage through which fuel flows generally along a supply axis. A nozzle plate having a top surface and a bottom surface is mounted onto the valve seat. The top surface includes a recess formed therein whereby fuel flows into the recess from the supply passage. A plurality of swirl chambers are formed within the top surface, each having a conical orifice extending from the swirl chamber to the bottom surface of the nozzle plate. A plurality of channels interconnect each of the swirl chambers to the recess, wherein the channels meet the swirl chambers offset from a center of the swirl chambers.

49 Claims, 5 Drawing Sheets

FUEL INJECTOR SWIRL NOZZLE ASSEMBLY

TECHNICAL FIELD

The present invention generally relates to a fuel injector nozzle for providing fine atomization of fuel expelled into an internal combustion engine. More specifically, the present invention relates to an improved swirl type injector nozzle assembly.

BACKGROUND

Stringent emission standards for internal combustion engines suggest the use of advanced fuel metering techniques that provide extremely small fuel droplets. The fine atomization of the fuel not only improves emission quality of the exhaust, but also improves the cold start capabilities, fuel consumption, and performance. One way of creating a fine spray of fuel is to use a swirl nozzle that injects the fuel from the nozzle and keeps the fuel moving in a swirling motion as the fuel exits the orifices within the nozzle. Current swirl nozzles incorporate cylindrical orifices within the nozzle, which suppress the swirling motion of the fuel as the fuel passes through the orifices. Therefore, there is a need in the industry for a fuel injector nozzle that will induce a swirling motion into the fuel flow prior to entering the orifices and the orifices will enhance the swirling motion of the fuel to provide fine atomization of the fuel that is injected into the cylinder.

DETAILED DESCRIPTION OF THE PREFERRED EMBODIMENT

The following description of the preferred embodiment of the invention is not intended to limit the scope of the invention to this preferred embodiment, but rather to enable any person skilled in the art to make and use the invention.

Figure 1:
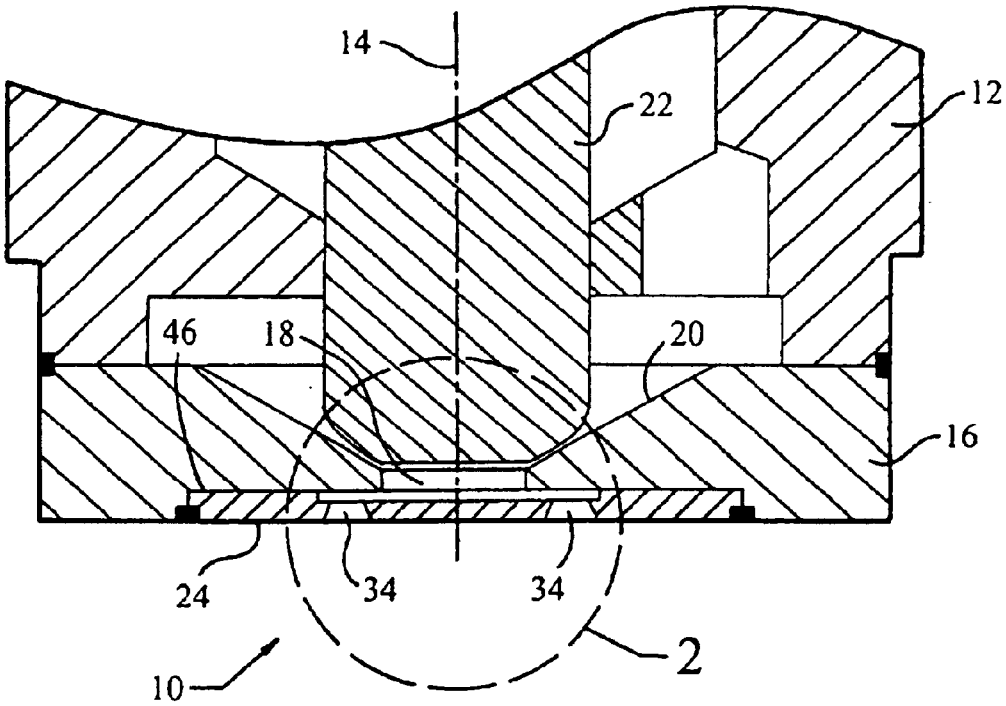
FIG. 1 is a cross-sectional view of a preferred embodiment of a fuel injector nozzle assembly of the present invention shown in a closed state.
Figure 2:
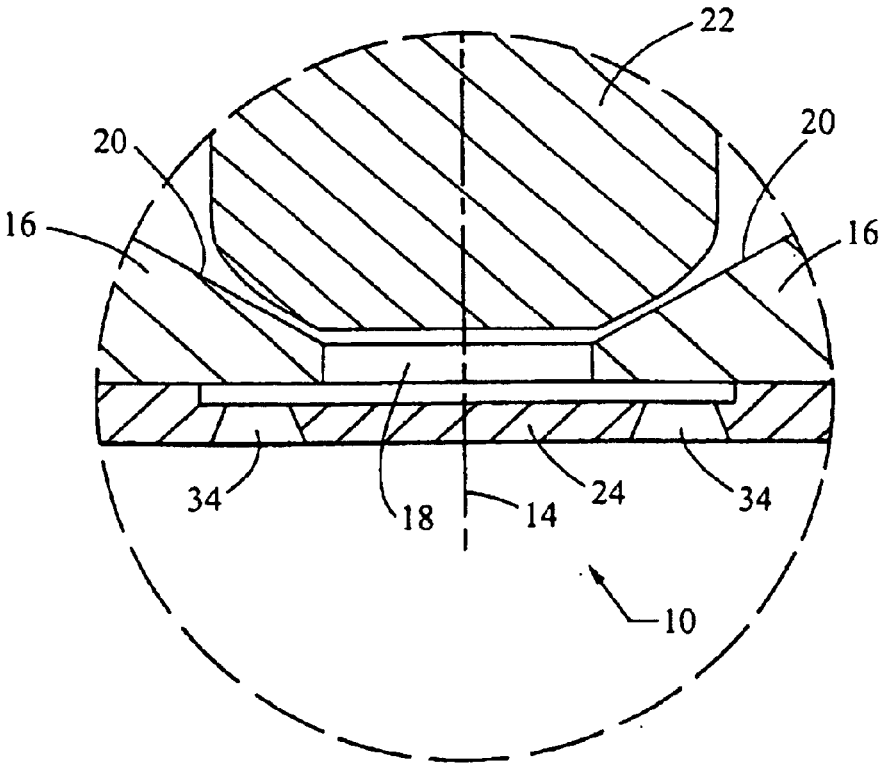
FIG. 2 is a close up view of a portion of FIG. 1 shown in an open state.

Referring to FIGS. 1 and 2, a fuel injector nozzle assembly of the preferred embodiment of the present invention is shown generally at 10. The fuel injector nozzle assembly 10 includes an injector body 12 which defines a supply axis 14 through which fuel flows. A distal end of the injector body 12 defines a valve seat 16. The valve seat 16 has a supply passage 18 through which fuel flows outward from the injector body 12. An upper surface 20 of the valve seat 16 is adapted to engage a valve 22 to selectively seal the supply passage 18 to block the flow of fuel from the injector body 12.

Referring to FIGS. 3–6, a nozzle plate 24 is mounted onto the valve seat 16. The nozzle plate 24 includes a top surface 26 and a bottom surface 28. The top surface 26 includes a recess 30 formed therein such that fuel flows from the supply passage 18 into the recess 30. The top surface 26 of the nozzle plate 24 also includes a plurality of swirl chambers 32 formed therein. Each of the swirl chambers 32 includes a conical orifice hole 34 extending downward from the swirl chamber 32 to the bottom surface 28 of the nozzle plate 24. A plurality of channels 38 formed within the top surface 26 of the nozzle plate 24 interconnect the swirl chambers 32 to the recess 30. In the preferred embodiment, the nozzle plate 24 is made from metal, and is welded onto the valve seat 16. Specifically, the nozzle plate 24 is preferably made from stainless steel, and is attached to the valve seat 16 by laser welding.

Preferably, the orifice holes 34 are round and conical, extending downward such that the narrow end of the conical orifice holes 34 connect with the swirl chambers 32. The fuel flowing through the orifice holes 34 can freely expand inside the conical orifice hole 34 without suppression.

Figure 5:
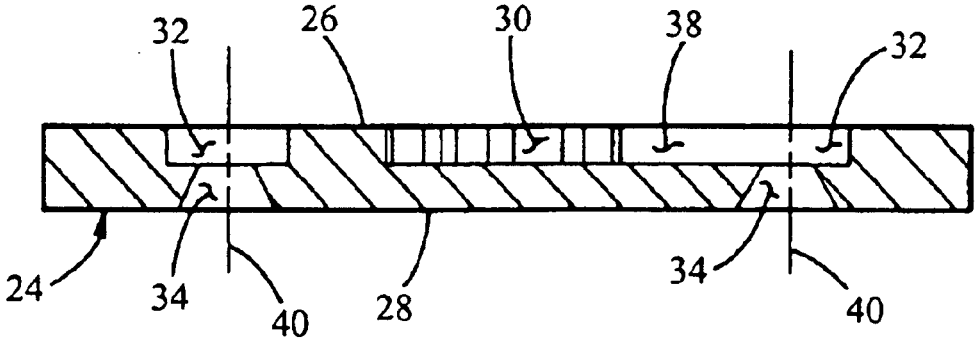
FIG. 5 is a side cross-sectional view of the nozzle plate taken along line A—A of FIG. 4 shown where an axis of the orifice holes is parallel to a supply axis of the assembly.
Figure 6:
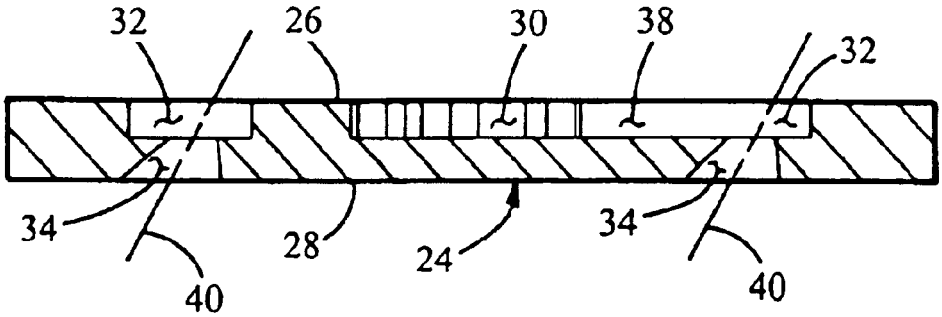
FIG. 6 is a side cross-sectional view of the nozzle plate taken along line A—A of FIG. 4 shown where an axis of the orifice holes is skewed relative to the supply axis of the assembly.

The cone angle of the conical orifice holes 34 can be adjusted to change the spray angle of the fuel. Referring to FIG. 5, the conical orifice holes 34 include a centerline 40 which is parallel to the supply axis 14. However, the centerline 40 of the conical orifice holes 34 can also be skewed relative to the supply axis 14 as shown in FIG. 6 to meet particular packaging and targeting requirements of the injector assembly 10. In conventional nozzles, alterations to the spray angle and skewing the spray relative to the axis 14 of the injector will typically have a corresponding affect on the spray quality. The nozzle assembly 10 of the present invention can be tailored for spray angle and skewed relative to the injector axis 14 with minimal corresponding affect on the spray quality, by orienting the conical orifice holes 34 at an angle relative to the injector axis 14.

Figure 7:
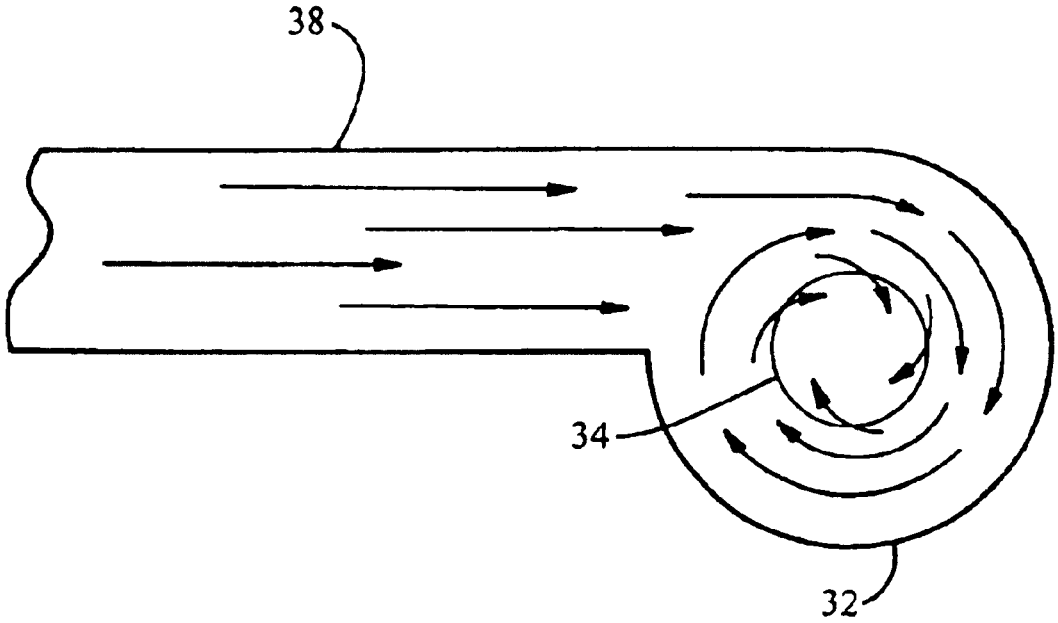
FIG. 7 is top view of one swirl chamber and channel showing the fuel flow patterns therein.
Figure 8:
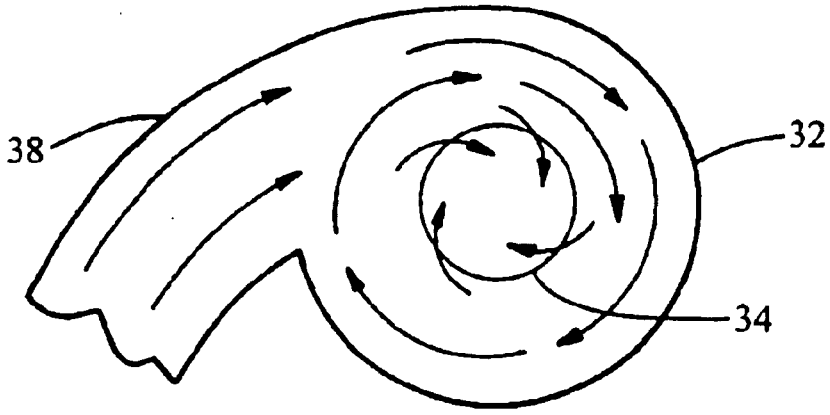
FIG. 8 is a top view of a swirl chamber and an alternative channel showing the fuel flow patterns therein.

Fuel flows through the supply passage 18 into the recess 30 within the nozzle plate 24 and then into each of the channels 38. The fuel flows through the channels 38 into the swirl chambers 32. Referring to FIG. 7, the channels 38 meet the swirl chambers 32 offset from the center of the swirl chamber 32. Preferably, the swirl chambers 32 are circular in shape, such that the wall of the channel 38 that is furthest from the center of the swirl channel 32 meets the outer edge of the swirl channel 32 tangentially. When the fuel enters the swirl chamber 32, the flow smoothly follows the circular walls of the swirl chamber 32 and is forced to swirl within the swirl chamber 32. It is to be understood that the swirl chamber 32 could be other shapes that are effective to induce a swirling motion to the fuel. Preferably, the channels 38 are straight, as shown in FIG. 7, however, the channels 38 could also be curved as shown in FIG. 8, or have other shapes.

Figure 9:
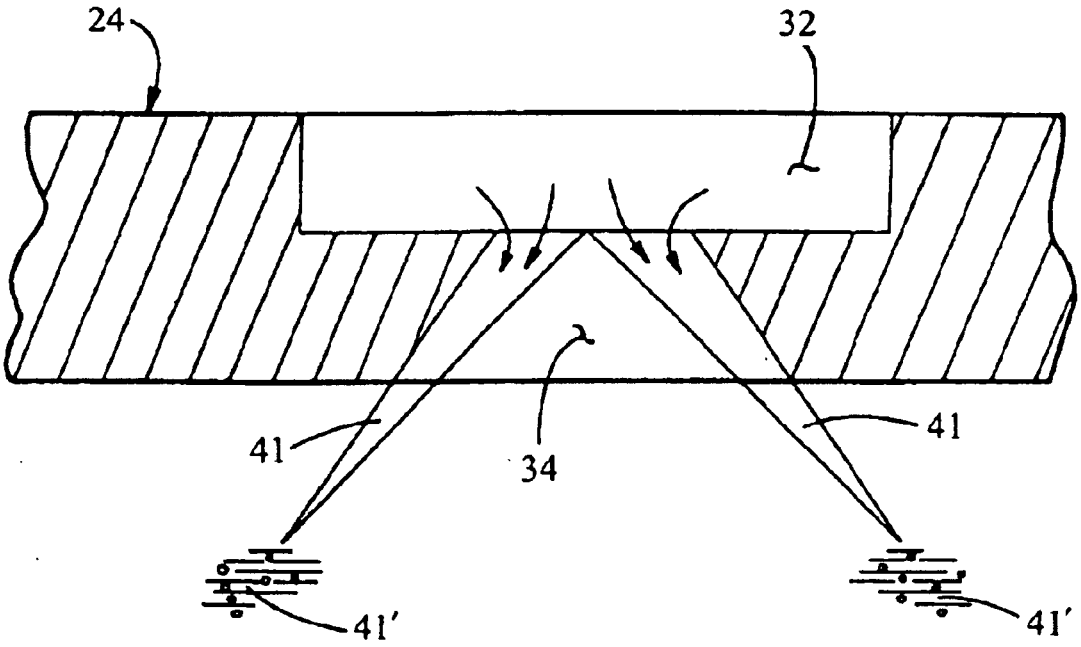
FIG. 9 is a side cross sectional view of a swirl chamber and orifice hole showing how the fuel disperses from the orifice hole.

Referring to FIG. 9, the fuel that is swirling within the swirl chambers 32 is rapidly discharged through the conical orifice holes 34. The fuel is discharged from the orifice holes 34 as conical sheets 41 which merge with each other and quickly disintegrate into a finely atomized spray 41'.

Preferably, the orifice holes 34 are located at the center of the swirl chambers 32 such that the orifice holes 34 are at the center of the swirling fuel.

Figure 4:
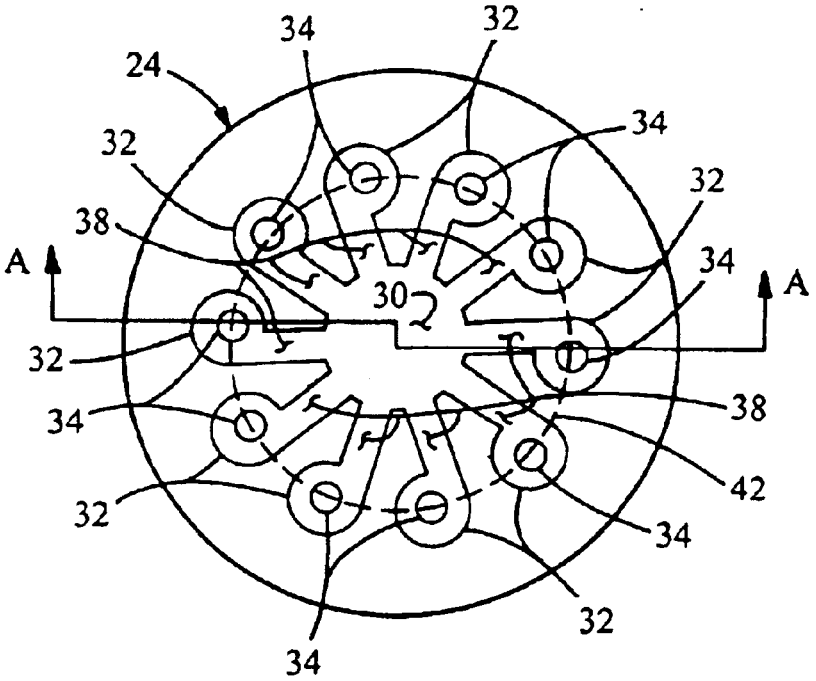
FIG. 4 is a top view of the nozzle plate where the orifice holes are in a circular pattern.
Figure 10:
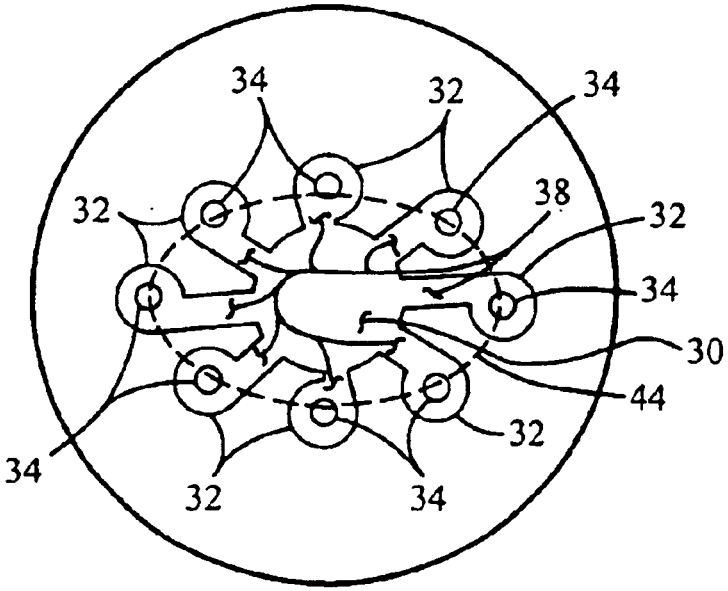
FIG. 10 is a top view of the nozzle plate where the orifice holes are in an oval pattern.

Referring to FIG. 4, in the preferred embodiment the plurality of orifice holes 34 are evenly distributed along a circular pattern 42. The circular pattern 42 on which the orifice holes 34 are distributed is preferably concentric with the recess 30, but could also be offset from the center of the recess 30. The circular pattern 42 has a diameter which is larger than the first recess 30 such that the orifice holes 34 are outside of the recess 30. Referring to FIG. 10, the orifice holes 34 could also fall on an oval pattern 44. It is to be understood that the pattern of the orifice holes 34 could be any suitable pattern and is to be determined based upon the required spray characteristics of the particular application.

Figure 3:
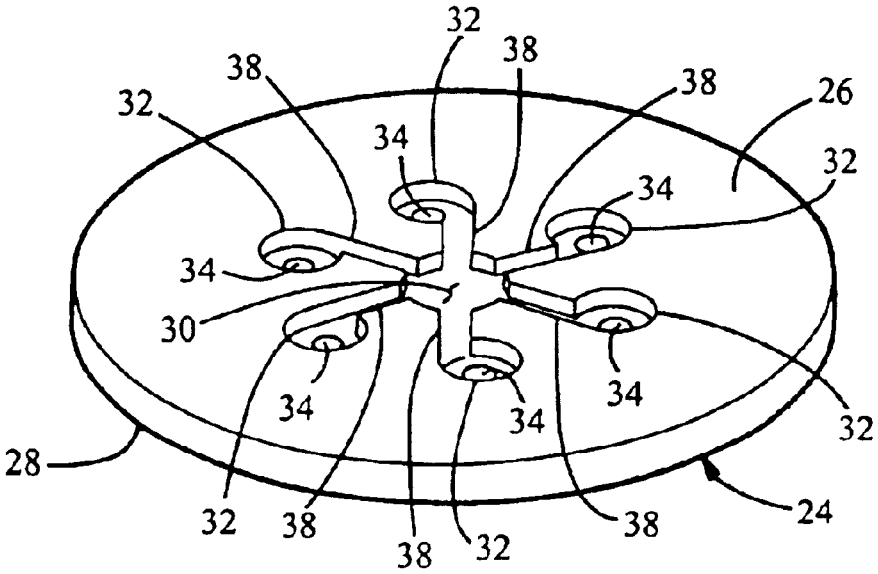
FIG. 3 is a perspective view of a nozzle plate of the injector nozzle assembly.

The number of orifice holes 34 depends upon the design characteristics of the injector assembly 10. The nozzle plate 24 shown in FIG. 3 is shown with six orifice holes 34 and the nozzle plate 24 shown in FIG. 4 is shown with ten orifice holes 34, while the nozzle plate 24 shown in FIG. 10 is shown with eight orifice holes 34. By changing the number of orifice holes 34 within the nozzle plate 24, the flow rate of the injector assembly 10 can be adjusted without affecting the spray pattern or droplet size of the fuel. In the past, in order to adjust the flow rate, the pressure would be increased or decreased, or the size of the orifice holes adjusted, either of which would lead to altered spray characteristics of the fuel. The present invention allows the flow rate of the injector assembly 10 to be adjusted by selecting an appropriate number of orifice holes 34 without a corresponding deterioration of the spray. By including additional orifice holes 34 with the same dimensions, the total amount of fuel flowing is increased. However, each individual orifice hole 34 will produce identical spray characteristics, thereby maintaining the spray characteristics of the overall flow.

Referring again to FIG. 1, the valve seat 16 includes a recess 46 formed within a bottom surface. The shape of the recess 46 corresponds to the shape of the nozzle plate 24 so the nozzle plate 24 can be received within the recess 46 and welded in place. In the preferred embodiment, the nozzle plate 24 is circular, and the recess 46 is circular having a depth equal to the thickness of the nozzle plate 24. The overall diameter of the nozzle plate 24 is determined based upon the overall design of the assembly 10. The diameter must be large enough to prevent deformation of the orifice holes 34 by the laser welding when the nozzle plate 24 is welded to the valve seat 16. The diameter, however, must also be small enough to minimize deflection of the nozzle plate 24 under pressure to insure that there is no separation between the nozzle plate 24 and the valve seat 16. Alternatively, the valve seat 16 could be flat, with no recess 46, wherein the nozzle plate 24 is welded onto the bottom surface of the valve seat 16. The presence of the recess 46 within the valve seat is optional.

The foregoing discussion discloses and describes the preferred embodiment of the invention. One skilled in the art will readily recognize from such discussion, and from the accompanying drawings and claims, that changes and modifications can be made to the invention without departing from the true spirit and fair scope of the invention as defined in the following claims. The invention has been described in an illustrative manner, and it is to be understood that the terminology which has been used is intended to be in the nature of words of description rather than of limitation.

I claim:

1. A fuel injector nozzle assembly comprising:

an injector body including a valve seat with a supply passage through which fuel flows generally along a supply axis; and a nozzle plate having a top surface and a bottom surface mounted onto said valve seat, said top surface having a recess adapted to receive fuel from said supply passage, a plurality of swirl chambers formed within said top surface, each swirl chamber having a conical orifice extending from a center of said swirl chamber to said bottom surface of said nozzle plate, and a plurality of channels interconnecting said swirl chambers and said recess;

said plurality of orifice holes being evenly distributed along an oval pattern.

2. The fuel injector nozzle assembly of claim 1 wherein said channels meet said swirl chambers offset from a center of said swirl chambers.

3. The fuel injector nozzle assembly of claim 2 wherein said nozzle plate is made from metal and is welded onto said valve seat.

4. The fuel injector nozzle assembly of claim 3 wherein said nozzle assembly is made from stainless steel.

5. The fuel injector nozzle assembly of claim 1 wherein said recess within said nozzle plate is generally circular in shape.

6. The fuel injector nozzle assembly of claim 1 wherein each of said orifice holes includes a centerline, said centerline being parallel to said supply axis.

7. The fuel injector nozzle assembly of claim 1 wherein each of said orifice holes includes a center line, said center line being angled relative to said supply axis.

8. The fuel injector nozzle assembly of claim 1 wherein said valve seat includes a recess, wherein said nozzle plate is shaped such that said nozzle plate is received within said recess.

9. The fuel injector nozzle assembly of claim 1 wherein said swirl chambers are circular in shape.

10. The fuel injector nozzle assembly of claim 1 wherein said channels are straight.

11. The fuel injector nozzle assembly of claim 1 wherein said channels are curved.

12. A nozzle plate comprising:

a top surface and a bottom surface;

a circular recess formed within said top surface and adapted to receive a flow of fuel;

a plurality of circular swirl chambers formed within said top surface, each swirl chamber having a conical orifice hole located at a center and extending from said swirl chamber to said bottom surface;

said plurality of orifice holes are evenly distributed along an oval pattern which is concentric with said recess; and a plurality of channels interconnecting said swirl chambers and said recess.

13. The nozzle plate of claim 12 wherein said channels meet said swirl chambers offset from a center of said swirl chambers.

14. The nozzle plate of claim 12 wherein each of said orifice holes includes a centerline that is parallel to a supply axis.

15. The nozzle plate of claim 12 wherein each of said orifice holes includes a centerline that is angled relative to a supply axis.

16. The nozzle plate of claim 12 wherein said channels are straight.

17. The nozzle plate of claim 12 wherein said channels are curved.

18. The nozzle plate of claim 12 wherein said nozzle plate is formed from stainless steel.

19. A nozzle plate comprising:

a top surface and a bottom surface;

a circular recess formed within said top surface and adapted to receive a flow of fuel;

a plurality of circular swirl chambers formed within said top surface, each swirl chamber having a conical orifice hole located at a center and extending from said swirl chamber to said bottom surface, each of said orifice holes including a centerline that is angled relative to a supply axis; and a plurality of channels interconnecting said swirl chambers and said recess.

20. The nozzle plate of claim 19 wherein said channels meet said swirl chambers offset from a center of said swirl chambers.

21. The nozzle plate of claim 19 wherein said plurality of orifice holes are evenly distributed along a circular pattern which is concentric with said recess and has a diameter larger than said recess.

22. The nozzle plate of claim 19 wherein said plurality of orifice holes are evenly distributed along an oval pattern.

23. The nozzle plate of claim 19 wherein said channels are straight.

24. The nozzle plate of claim 19 wherein said channels are curved.

25. A nozzle plate comprising:

a top surface and a bottom surface;

a circular recess formed within said top surface and adapted to receive a flow of fuel;

a plurality of circular swirl chambers formed within said top surface, each swirl chamber having a conical orifice hole located at a center and extending from said swirl chamber to said bottom surface; and a plurality of curved channels interconnecting said swirl chambers and said recess.

26. The nozzle plate of claim 25 wherein said channels meet said swirl chambers offset from a center of said swirl chambers.

27. The nozzle plate of claim 25 wherein said plurality of orifice holes are evenly distributed along a circular pattern which is concentric with said recess and has a diameter larger than said recess.

28. The nozzle plate of claim 25 wherein said plurality of orifice holes are evenly distributed along an oval pattern.

29. The nozzle plate of claim 25 wherein each of said orifice holes includes a centerline that is parallel to a supply axis.

30. The nozzle plate of claim 25 wherein each of said orifice holes includes a centerline that is angled relative to a supply axis.

31. A fuel injector nozzle assembly comprising:

an injector body including a valve seat with a supply passage through which fuel flows generally along a supply axis; and a nozzle plate having a top surface and a bottom surface mounted onto said valve seat, said top surface having a recess adapted to receive fuel from said supply passage, a plurality of swirl chambers formed within said top surface, each swirl chamber having a conical orifice extending from a center of said swirl chamber to said bottom surface of said nozzle plate, and a plurality of channels interconnecting said swirl chambers and said recess;

each of said orifice holes including a center line, said center line being angled relative to said supply axis.

32. The fuel injector nozzle assembly of claim 31 wherein said channels meet said swirl chambers offset from a center of said swirl chambers.

33. The fuel injector nozzle assembly of claim 31 wherein said recess within said nozzle plate is generally circular in shape.

34. The fuel injector nozzle assembly of claim 33 wherein said plurality of orifice holes are evenly distributed along a circular pattern, said circular pattern having a diameter larger than said recess.

35. The fuel injector nozzle assembly of claim 34 wherein said circular pattern is concentric with said recess.

36. The fuel injector nozzle assembly of claim 31 wherein said valve seat includes a recess, wherein said nozzle plate is shaped such that said nozzle plate is received within said recess.

37. The fuel injector nozzle assembly of claim 31 wherein said swirl chambers are circular in shape.

38. The fuel injector nozzle assembly of claim 31 wherein said channels are straight.

39. The fuel injector nozzle assembly of claim 31 wherein said channels are curved.

40. A fuel injector nozzle assembly comprising:

an injector body including a valve seat with a supply passage through which fuel flows generally along a supply axis; and a nozzle plate having a top surface and a bottom surface mounted onto said valve seat, said top surface having a recess adapted to receive fuel from said supply passage, a plurality of swirl chambers formed within said top surface, each swirl chamber having a conical orifice extending from a center of said swirl chamber to said bottom surface of said nozzle plate, and a plurality of curved channels interconnecting said swirl chambers and said recess.

41. The fuel injector nozzle assembly of claim 40 wherein said channels meet said swirl chambers offset from a center of said swirl chambers.

42. The fuel injector nozzle assembly of claim 40 wherein said recess within said nozzle plate is generally circular in shape.

43. The fuel injector nozzle assembly of claim 42 wherein said plurality of orifice holes are evenly distributed along a circular pattern, said circular pattern having a diameter larger than said recess.

44. The fuel injector nozzle assembly of claim 43 wherein said circular pattern is concentric with said recess.

45. The fuel injector nozzle assembly of claim 40 wherein said plurality of orifice holes are evenly distributed along an oval pattern.

46. The fuel injector nozzle assembly of claim 40 wherein each of said orifice holes includes a centerline, said centerline being parallel to said supply axis.

47. The fuel injector nozzle assembly of claim 40 wherein each of said orifice holes includes a center line, said center line being angled relative to said supply axis.

48. The fuel injector nozzle assembly of claim 40 wherein said valve seat includes a recess, wherein said nozzle plate is shaped such that said nozzle plate is received within said recess.

49. The fuel injector nozzle assembly of claim 40 wherein said swirl chambers are circular in shape.

* * * * *